US010014585B2

(12) United States Patent
Patron et al.

(10) Patent No.: US 10,014,585 B2
(45) Date of Patent: Jul. 3, 2018

(54) MINIATURIZED RECONFIGURABLE CRLH METAMATERIAL LEAKY-WAVE ANTENNA USING COMPLEMENTARY SPLIT-RING RESONATORS

(71) Applicant: Drexel University, Philadelphia, PA (US)

(72) Inventors: Damiano Patron, Philadelphia, PA (US); Kapil R. Dandekar, Philadelphia, PA (US)

(73) Assignee: Drexel University, Philadelphia, PA (US)

( * ) Notice: Subject to any disclaimer, the term of this patent is extended or adjusted under 35 U.S.C. 154(b) by 0 days.

(21) Appl. No.: 15/205,551

(22) Filed: Jul. 8, 2016

(65) Prior Publication Data

US 2017/0062943 A1 Mar. 2, 2017

Related U.S. Application Data

(60) Provisional application No. 62/189,913, filed on Jul. 8, 2015.

(51) Int. Cl.
*H01Q 13/28* (2006.01)
*H01Q 3/44* (2006.01)
*H01Q 15/00* (2006.01)

(52) U.S. Cl.
CPC ..... *H01Q 13/28* (2013.01); *H01Q 3/443* (2013.01); *H01Q 15/0086* (2013.01)

(58) Field of Classification Search
CPC .... H01Q 13/28; H01Q 15/0086; H01Q 13/20; H01Q 13/206; H01Q 3/443
See application file for complete search history.

(56) References Cited

U.S. PATENT DOCUMENTS

2010/0156573 A1* 6/2010 Smith ..... H01P 3/081 333/239

OTHER PUBLICATIONS

Cheng et al., "A Compact Omnidirectional Self-Packaged Patch Antenna With Complementary Split-Ring Resonator Loading for Wireless Endoscope Applications", IEEE Transactions on Antennas and Propagation, 2011, 10, 1532-1535.

(Continued)

*Primary Examiner* — Robert Karacsony
(74) *Attorney, Agent, or Firm* — Baker & Hostetler LLP

(57) ABSTRACT

Composite Right/Left Handed (CRLH) Leaky-Wave Antennas (LWAs) are a class of radiating elements characterized by an electronically steerable radiation pattern. The design is comprised of a cascade of CRLH unit-cells populated with varactor diodes. By varying the voltage across the varactor diodes, the antenna can steer its directional beam from broadside to backward and forward end-fire directions. A CRLH Leaky-Wave Antenna for the 2.4 GHz Wi-Fi band is miniaturized by etching a Complementary Split-Ring Resonator (CSRR) underneath each CRLH unit-cell. As opposed to conventional LWA designs, the LWA layout does not require thin interdigital capacitors, significantly reducing the PCB manufacturing constraints required to achieve size reduction. The resulting antenna enables CRLH LWAs to be used not only for wireless access points, but also potentially for mobile devices.

18 Claims, 14 Drawing Sheets

(56) References Cited

OTHER PUBLICATIONS

Lim et al., "Metamaterial-based electronically controlled transmission-line as a novel leaky-wave antenna with tunable radiation angle and beamwidth", IEEE Transactions on Microwave Theory and Techniques, Jun. 2004, 52(12), 2678-2690.
Patron et al., "Improved Design of a CRLH leaky-wave antenna and its application for DoA estimation", IEEE Topical Conference on Antennas and Propagation in Wireless Communications (APWC), Sep. 2013, 1343-1346.
Pei et al., "Miniaturized Triple-Band Antenna With a Defected Ground Plane for WLAN/WiMAX Applications", IEEE Transactions on Antennas and Propagation, Antennas and Wireless Propagation Letters, 2011, 10, 298-301.
Piazza et al., "Two port reconfigurable CRLH leaky wave antenna with improved impedance matching and beam tuning", Antennas and Propagation, EuCAP 2009. 3rd European Conference on IEEE, 2009, 2046-2049.
Sharawi et al., "A CSRR Loaded MIMO Antenna System for ISM Band Operation", IEEE Transactions on Antennas and Propagation, Aug. 2013, 61(8), 4265-4274.
Xie et al., "A Novel Dual-Band Patch Antenna With Complementary Split Ring Resonators Embedded in the Ground Plane", Progress in Electromagnetics Research Letters, 2011, 25, 117-126.

* cited by examiner

Fig. 10(a)
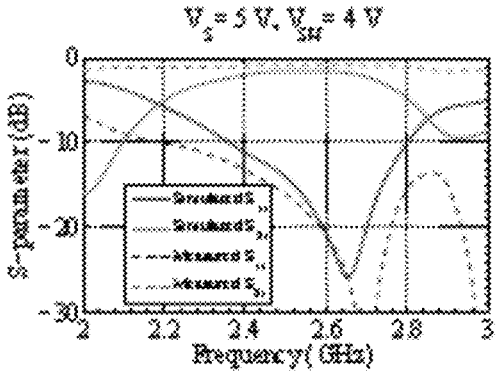
Fig. 10(b)
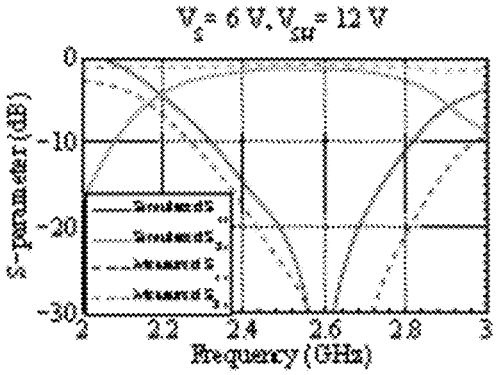
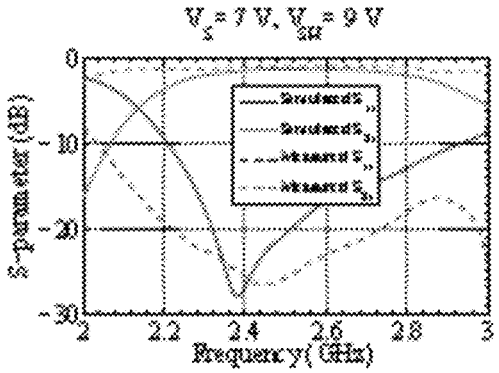
Fig. 10(c)
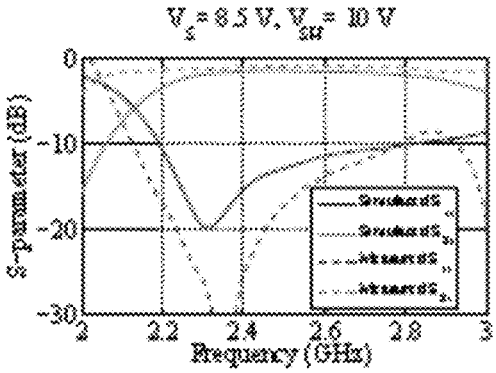
Fig. 10(d)

Fig. 13(a)
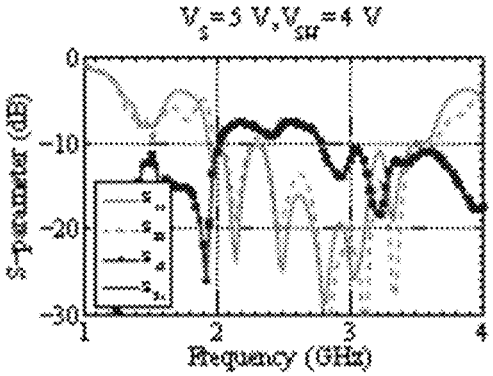
Fig. 13(b)
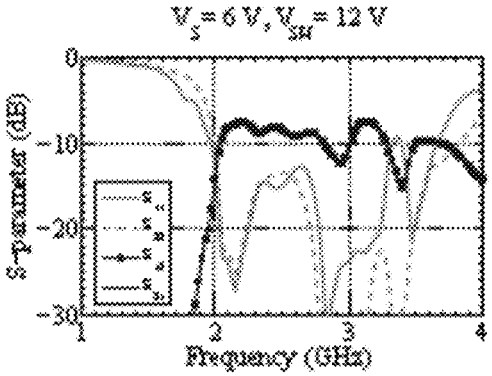
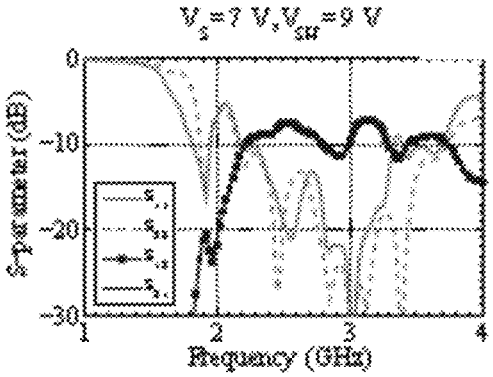
Fig. 13(c)
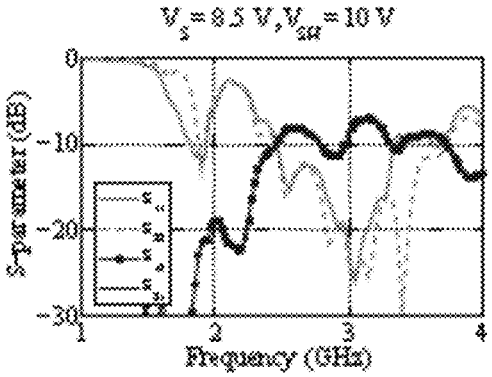
Fig. 13(d)

Fig. 14(a)
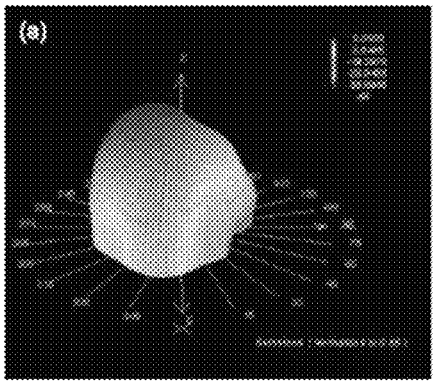
Fig. 14(b)
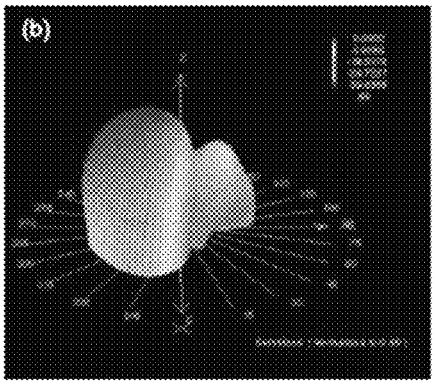
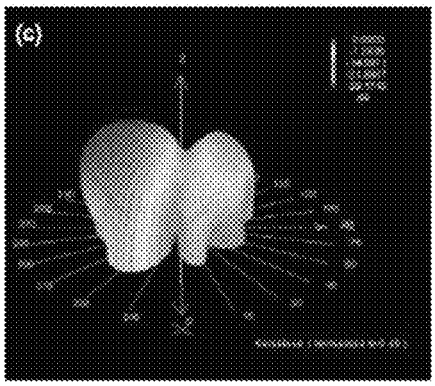
Fig. 14(c)
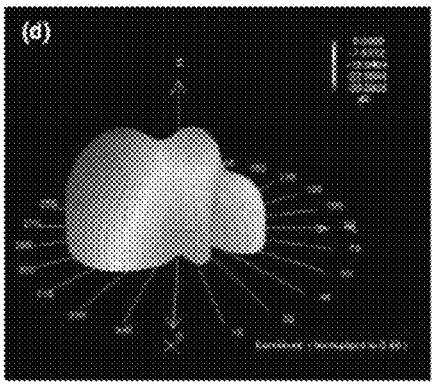
Fig. 14(d)

Fig. 16(a)
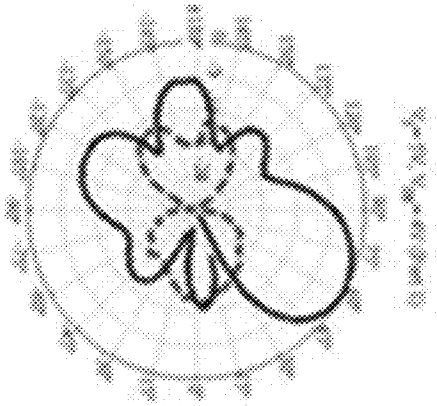
Fig. 16(b)
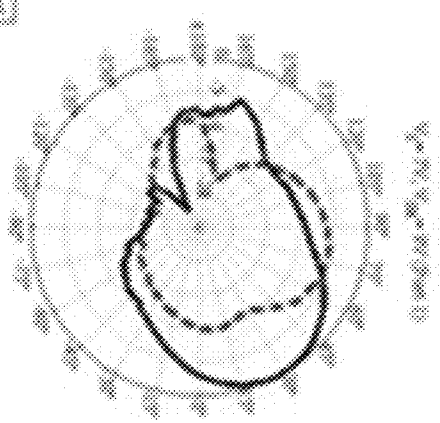
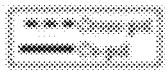
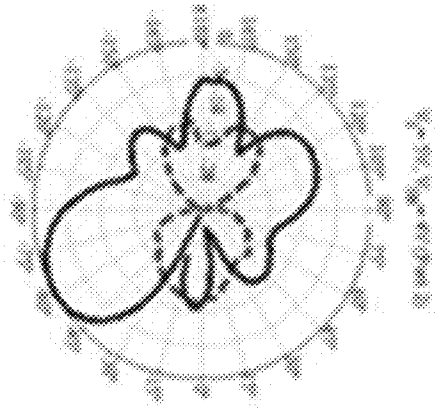
Fig. 16(c)
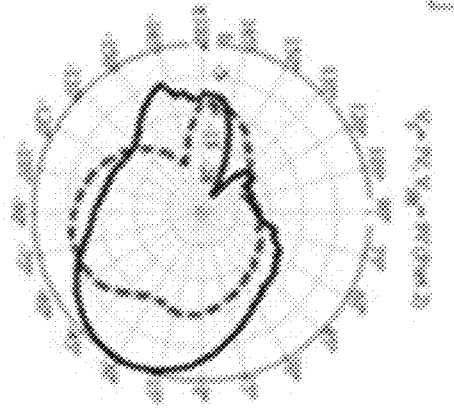
Fig. 16(d)

MINIATURIZED RECONFIGURABLE CRLH METAMATERIAL LEAKY-WAVE ANTENNA USING COMPLEMENTARY SPLIT-RING RESONATORS

CROSS-REFERENCE TO RELATED APPLICATIONS

The present application claims priority to U.S. Provisional Patent Application No. 62/189,913, filed Jul. 8, 2015. The contents of that application are hereby incorporated by reference.

GOVERNMENT RIGHTS

This invention was made with government support under Contracts ECS 1028608 and CNS-1147838 awarded by the National Science Foundation. The Government has certain rights in the invention.

TECHNICAL FIELD

The invention relates to reconfigurable antennas and, more particularly, to a miniaturized reconfigurable metamaterial-based CRLH leaky-wave antenna capable of steering a directive beam from broadside to backward and forward directions. The disclosed antenna uses complementary split-ring resonators in the ground plane of each unit cell and allows for a drastic reduction in the size of the antenna while maintaining good impedance matching, relatively high front-to-back ratio, and large beam steering.

BACKGROUND

Current antenna systems can be divided into three main categories: 1) antennas that radiate with a fixed pattern and polarization ("standard antennas"), 2) antennas including a matrix of active elements that radiate with variable pattern and/or polarization by appropriately phasing each active element ("phased array"), and 3) antennas including a single active element, showing a different pattern and polarization, depending upon the adopted current distribution on the radiating element ("reconfigurable antennas"). Phased arrays and reconfigurable antennas have received significant attention in the literature with respect to standard antennas thanks to their capability of dynamically changing their radiation properties in response to the multi-variate behavior of the wireless channel. The reconfigurable antenna is preferable over a phase array antenna mainly because it employs a single active element and thus occupies a small space. Reconfigurable antennas also allow for high radiation efficiency since they do not employ phase shifters and power dividers. Reconfigurable antennas also can adapt their characteristics in response to the behavior of the wireless channel and can be used for a variety of applications including throughput maximization, interference management, directional networking, and security.

Various types of reconfigurable antennas capable of changing pattern and polarization have been proposed in the literature. These antennas may employ embedded switches or variable capacitors to change the current distribution on the metallization of the active element or may employ an active antenna element surrounded by passive elements (i.e., parasitic elements) loaded with variable capacitors or connected to switches.

Particularly interesting is the design of Composite Right/Left-Handed (CRLH) Reconfigurable Leaky-Wave Antennas (LWAs), a two-port metamaterial-based design that is able to steer its directive beam from broadside to backward and forward angles. Leaky-wave antennas are based on the concept of traveling-wave, as opposed to conventional resonating-wave behavior. When an RF signal is applied to the input port, the traveling wave progressively "leaks" power as it travels along the waveguide structure. LWAs can also be seen as a phased array traveling wave antenna with amplitude decaying excitation and progressive phase shift as a result of the wave traveling along each unit cell. This leakage phenomenon is directly related to the directivity of the radiated beam.

The CRLH-LWA is a periodic structure made by a cascade of metamaterial unit cells, as shown in FIG. 1. FIG. 1 illustrates the CRLH-LWA design introduced by Patron et al. in "Improved Design of a CRLH leaky-wave antenna and its application for DoA Estimation," Proc. IEEE-APS Topical Conference on Antennas and Propagation in Wireless Communications (APWC), pp. 1343-1346, September 2013. The design of the single unit cell is appropriately tuned for the propagation constant $\beta$ to operate within the radiated region of the dispersive curve, which means $\beta<k_0$ where $k_0$ is the free space wavenumber. By populating the unit cell with varactor diodes in series and shunt configuration, the propagation constant $\beta$ of the waveguide can be electronically changed through two DC voltages ($V_S$, $V_{SH}$) from left-hand (LH) to right-hand (RH). This variation of the propagation constant $\beta$ determines the angle of the radiated main beam. As illustrated in FIG. 2, the antenna consists of a cascade of several unit cells. The CRLH behavior is determined by designing the unit cell to have proper series capacitance and shunt inductive component by means of a shunt microstrip stub. The series capacitance can be varied through two varactor diodes $D_{S1}$ and $D_{S2}$, while the shunt component is varied through the varactor $D_{SH}$. A capacitor (C) is added to the shunt stub in order to decouple the two bias voltages $V_S$ and $V_{SH}$. Thus, these two bias voltages will modulate the propagation constant $\beta$ along the waveguide and provide the beam steering. Unlike previous LWA designs, this LWA antenna avoids the use of interdigitated capacitors as part of the CRLH equivalent model. As a result, the manufacturing challenges that may be introduced by etching the very thin fingers that constitute the interdigital capacitors are avoided. Consequently, enhanced symmetry between the two input ports is achieved and it also opens a new venue for miniaturization of such a design. The form factor of the antenna can also be reduced by designing the DC lines with spiral and folded RF chokes as well as using lumped elements (L). Prior art designs used long quarter-wavelength transformers for DC biasing.

Although the planar and compact form factor of such LWAs make them suitable for wireless base stations, they conventionally cannot be exploited on mobile devices due to size constraints. The present invention addresses this limitation by presenting an approach that will make LWAs more suitable for mobile devices.

Current attempts to miniaturize antenna dimensions involve the use of non-conventional substrates with high or enhanced dielectric constant. Other techniques were developed where the substrate is made by stacking reactive/magnetic layers. Unfortunately, these techniques introduce more manufacturing complexity and bulk.

On the other hand, recent developments in defected ground structures have shown the possibility of simply properly etching the ground plane of transmission lines or antennas in order to change their cut-off and resonant frequencies. As a result, devices with small dimension can be loaded with complementary split-ring resonators (CSRRs) on the ground plane to resonate at lower frequencies, achieving miniaturization. However, conventional broadside antennas loaded with CSRR for miniaturization suffer from significant back-lobe radiations, thus degrading the front-to-back ratio of the broadside radiation. See, e.g., Sharawi, et al., "A CSRR Loaded MIMO Antenna System for ISM Band Operation," IEEE Transaction on Antennas and Propagation, Vol. 61, N. 8, August, 2013; Cheng, et al., "A compact omnidirectional self-packages patch antenna with complementary split-ring resonator loading for wireless endoscope application," Antennas and Wireless Propagation Letters, IEEE 10: 1532-1535, 2011; Pei, et al., "Miniaturized triple-band antenna with a defected ground plane for WLAN/WiMAX applications," Antennas and Wireless Propagation Letters, IEEE 10: 298-301, 2011; and Xie, et al., "A novel dual-band patch antenna with complementary split ring resonators embedded in the ground plane," Progress in Electromagnetics Research Letters, Vol. 25, pp. 117-126, 2011. In such systems, the defected ground structure created by the CSRR causes a leakage of the radiation pattern through the ground plane so as to generate a higher amplitude of the back lobe.

Others applications of metamaterials in the art uses split-ring resonators and complementary split-ring resonators for designing transmission lines, filters, and other applications where an electromagnetic wave is propagated through a circuit. In these applications, the transmission lines and filters can be miniaturized or specific performance can be achieved by etching CSRRs underneath the main transmission line. However, filters and transmission lines are used to propagate RF energy, while reconfigurable leaky-wave antennas are used to radiate the energy toward controllable angles. In other applications, split-ring resonators are used to design frequency-reconfigurable antennas where the split-ring resonators are used as resonating elements on the radiating side of the antennas. Such approaches are not used to provide miniaturization techniques for reconfigurable leaky-wave antennas so that such antennas may be used on mobile devices and the like where small size is a significant requirement.

SUMMARY

The invention addresses the needs in the art in a way that is different from the above-referenced prior art approaches in that it uses the CSRRs for miniaturization of reconfigurable leaky-wave antennas. As noted above, miniaturization techniques in the prior art have been applied to "static" antennas (antennas with a fixed radiation pattern). The invention described herein applies defected ground techniques (e.g., designing complementary resonators) to achieve miniaturization of reconfigurable antennas. In particular, the invention improves upon the LWA design of FIG. 1 by applying a periodic defected ground structure to achieve miniaturization of metamaterial-based antennas. The overall dimension can be reduced by more than 50%, while maintaining good impedance matching, relatively high front-to-back ratio, and large beam steering. The techniques is also quite cost-effective as it just requires an additional PCB etching on the LWA ground plane.

In exemplary embodiments of the invention, a reconfigurable leaky-wave antenna includes a plurality of cascaded metamaterial unit cells where each cell has a complementary resonator in its ground plane and adjustable varactor diodes that are biased to change a propagation constant through the plurality of cascaded metamaterial unit cells so that a directive beam from the antenna can be steered around an azimuth plane. The metamaterial unit cells comprise CRLH unit cells preferably placed on top of complementary resonators in the ground plane. The complementary resonator may be a split-ring resonator or any complementary resonator having a shape (e.g., triangular or rectangular) and a number for each unit cell that is varied based on the size, frequency, bandwidth, or radiation pattern characteristics of the CRLH unit cell.

In exemplary embodiments, the reconfigurable leaky-wave antenna of the invention is formed by etching a complementary resonator in a ground plane for each metamaterial unit cell, providing a CRLH leaky-wave transmission line on top of the complementary resonator for each metamaterial unit cell, and placing a plurality of cascaded metamaterial unit cells between respective ports. The method also includes providing three adjustable varactor diodes for each metamaterial unit cell and biasing the adjustable varactor diodes to change a propagation constant through the plurality of cascaded metamaterial unit cells so that a directive beam from the antenna can be steered around an azimuth plane.

BRIEF DESCRIPTION OF THE DRAWINGS

The above and other characteristic features of the invention will be understood by those skilled in the art from the following detailed description of the invention in connection with the attached drawings, of which:

FIG. 3(*b*) illustrates a schematic of another embodiment of a CRLH unit cell.

FIG. 3(*c*) illustrates a dispersion diagram used to evaluate the propagation constant $\beta$ and estimate the main beam angle $\theta$.

FIG. 7(*b*) illustrates the 2D top layer layout and dimensions of the LWA unit cell of FIG. 7(*a*).

FIG. 7(*c*) illustrates the bottom layer with ground plane and CSRR design $r_1$=5 mm and $r_2$=4 mm for the CRLH-LWA unit cell of FIG. 7(*a*), where the gap g and the distance between the two rings is 0.5 mm.

FIG. 10(*a*), FIG. 10(*b*), FIG. 10(*c*) and FIG. 10(*d*) illustrate—the simulated and measured S—parameters for four different configurations where $V_S$ acts as major controller for the center frequency and $V_{SH}$ allows for fine-tuning and improvement of the impedance.

FIG. 13(*a*), FIG. 13(*b*), FIG. 13(*c*) and FIG. 13(*d*) illustrate the measured S-parameters of the miniaturized CRLH-LWA of the invention.

FIG. 14(*a*), FIG. 14(*b*), FIG. 14(*c*) and FIG. 14(*d*) illustrate the measured 3D radiation patterns at 2.46 GHz for four configurations. Port 2, oriented in +y direction was connected to a signal generator, while port 1 was terminated to a 50Ω matched load, for (a) $V_S$=8.5 V, $V_{SH}$=10 V (b) $B_S$=7 V, $V_{SH}$=9 V (c) $V_S$=6 V, $V_{SH}$=12 V (d) $V_S$=5 V, $V_{SH}$=4 V.

FIG. 16(*a*), FIG. 16(*b*), FIG. 16(*c*) and FIG. 16(*d*) illustrate co-pol and cross-pol of the beams at ±60° and ±30° showing that the miniaturization of the CRLH LWA maintains the linear polarization, with the cross-pol at least 5 dB lower than the co-pol.

DETAILED DESCRIPTION OF ILLUSTRATIVE EMBODIMENTS

Certain specific details are set forth in the following description with respect to FIGS. 3-17 to provide a thorough understanding of various embodiments of the invention. Certain well-known details are not set forth in the following disclosure, however, to avoid unnecessarily obscuring the various embodiments of the invention. Those of ordinary skill in the relevant art will understand that they can practice other embodiments of the invention without one or more of the details described below. Also, while various methods are described with reference to steps and sequences in the following disclosure, the description is intended to provide a clear implementation of embodiments of the invention, and the steps and sequences of steps should not be taken as required to practice the invention.

In accordance with the invention, the inventors apply a defected ground technique to achieve miniaturization of reconfigurable antennas. In particular, the inventors build upon the LWA design introduced by Patron et al. in "Improved Design of a CRLH leaky-wave antenna and its application for DoA Estimation," Proc. IEEE-APS Topical Conference on Antennas and Propagation in Wireless Communications (APWC), pp. 1343-1346, September 2013, in which, as opposed to the conventional LWAs, the inventors greatly reduce PCB manufacturing constraints by avoiding the use of thin interdigital capacitors. In accordance with the present invention, the inventors have now designed the miniaturized LWA by applying a CSRR underneath each unit cell to achieve miniaturization of the top layer radiating layout. The unit cell is designed and characterized to resonate at 2.4 GHz and provide the largest possible beamsteering. Relative to a conventional 2.4 GHz LWA, the overall dimension can be more than halved while maintaining good impedance matching, relatively high front-to-back ratio, and good beam steering performance. The miniaturized LWA is designed to exhibit good impedance matching within the 2.41-2.48 GHz band, for Wi-Fi operations on mobile devices such as laptops or tablets.

Figures 3A, 3B, 3C:
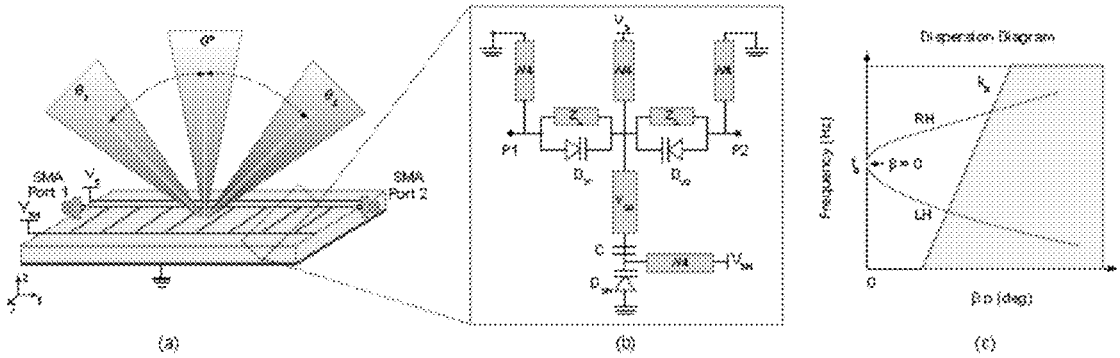
FIG. 3(*a*) illustrates a CRLH leaky-wave antenna with beam steering from broadside $\theta=0°$ to backward $\theta_1$ and forward $\theta_2$ angles of the type illustrated in FIG. 1 except that the CRLH-LWA has been miniaturized using the techniques of the invention.

The reconfigurable CRLH-LWA can be realized as a 2-port radiating element with tunable radiation properties. The layout is made by a series of N metamaterial unit cells as described by Caloz et al. in "Electromagnetic Metamaterials Transmission Line Theory and Application," Hoboken, N.J., John Wiley & Sons, 2006, cascaded in order to create a periodic structure from port 1 to port 2, as shown in FIG. 3(*a*). Unlike conventional resonating-wave antennas, the LWA is based on the concept of a traveling-wave. When a radio-frequency signal is applied to one of the input ports, the traveling wave leaks out energy as it progressively travels toward the second port. This energy leakage determines the directivity of the radiated beam and is a function of the propagation constant along the structure.

In LWAs, the radiation properties are determined by the complex propagation constant $\gamma=\alpha-j\beta$, where $\alpha$ is the attenuation constant and $\beta$ is the phase constant. While the former corresponds to a loss due to the leakage of energy, the latter determines the radiation angle of the main beam. Additionally, the relationship between $\beta$ and the wavenumber $k_0$ defines the regions of operation.

The dispersion diagram in FIG. 3(*c*) depicts the absolute value of $\beta$ and the two regions of operation. The darker area where $|\beta|>k_0$ represents the guided wave, where the energy is propagated from port 1 to port 2. The area where $|\beta|<k_0$ represents the radiated region. The angle of the main beam can be determined by the following equation:

$$\theta = \sin^{-1}\left(\frac{\beta}{k_0}\right) \tag{1}$$

If it is assumed that port 2 is fed an input signal and port 1 is terminated with a 50Ω load, at frequency $f_0$ where $\beta=0$, the antenna radiates a main lobe directed normal with respect to the antenna's plane, in broadside direction $\theta=0°$. For frequencies where $\beta>0$ (positive slope of $|\beta|$) the antenna operates in the RH region, steering the beam around the left semiplane $\theta_1$. On the other hand, when $\beta<0$ (negative slope of $|\beta|$) it operates in the LH region, and radiation occurs within the symmetric half-plane $\theta_2$. This frequency-dependent behavior allows for the scanning of the main beam from back-fire to end-fire directions. The introduction of tunable capacitances in the unit cell can turn the antenna from a frequency-controlled to a voltage-controlled beam steering radiator.

Several voltage-controlled LWAs have been developed in the literature (see Lim et al. "Electronically-Controlled Metamaterial-Based Transmission Line as a Continuous- Scanning Leaky-Wave Antenna," Proc. IEEE MTT-S International Symposium Digest, pp. 3123-316, June 2004; and Piazza et al. "Two Port Reconfigurable CRLH Leaky Wave Antenna with Improved Impedance Matching and Beam Tuning," Proc. European Conference on Antennas and Propagation EuCAP, pp. 2046-2049, March 2009) and the circuit model of the conventional metamaterial unit cell can be described as in FIG. 3(*b*). The structure is comprised of both series and shunt components. The series portion is designed with two interdigital capacitors and two varactor diodes $D_{S1}$ and $D_{S2}$ connected in parallel. The shunt portion is composed of a stub and a varactor diode $D_{SH}$ in series. By adding a varactor-loaded shunt stub, the shunt admittance $Y_{SH}$ of the unit cell can also be tuned. In addition, the independent control through $V_{SH}$ provides an additional degree of freedom, leading to improved tenability of scanning range and impedance matching. The capacitor C acts as DC-block for the two bias lines $V_S$ and $V_{SH}$. Three $\lambda/4$ microstrip transformers provide the DC bias lines to the diodes. The introduction of varactor diodes allows for a change in capacitance through the reverse bias voltage, and the propagation constant $\beta$ becomes a function of the diode's voltage. As a result, the curve depicted in FIG. 3(*c*) can be varied along the vertical axis, and the radiator can steer the main beam from backward to forward directions at a given frequency.

Unlike the aforementioned designs, for the miniaturization of the CRLH-LWA, the inventors took advantage of an improved design presented by Patron et al. in "Improved Design of a CRLH leaky-wave antenna and its application for DoA Estimation," Proc. IEEE-APS Topical Conference on Antennas and Propagation in Wireless Communications (APWC), pp. 1343-1346, September 2013, which avoids the use of interdigital capacitors as part of the unit cell model. Therefore, the inventors avoid the manufacturing challenges that may be introduced by etching the very thin fingers that constitute the interdigital capacitors. From a manufacturing and commercialization perspective, this is a significant advantage, especially as further research is conducted to miniaturize the layout.

The invention includes a Reconfigurable Leaky-Wave Antenna (RLWA) made by cascading several metamaterial unit cells, each of them loaded with a Complementary Split-Ring Resonator (CSRR) on the ground plane to achieve miniaturization. As noted above, the RLWA is a class of radiating elements based on the concept of a traveling-wave as opposed to the typical resonating-wave behavior. Thus, by properly biasing the varactor diodes, the propagation constant along the structure can be changed and, consequently, the directive beam can be steered around the azimuth plane. This antenna has two input ports and is made by cascading several composite right/left handed (CRLH) metamaterial unit cells, populated with varactor diodes for frequency and beam tuning. The center frequency as well as the radiation pattern of the antenna can be conveniently controlled by the DC biasing of the varactor diodes. This antenna has great potential in terms of spectral efficiency and pattern diversity. Taking advantage of the important features of this antenna in terms of frequency and pattern agility, the inventors apply a technique for the miniaturization of the antenna design that allows for integration on mobile devices such as laptops and tablets.

The miniaturization technique of the invention exploits the use of microstrip resonators to create a negative image of the layout of the ground plane of the structure. The complementary resonator is made by etching the ground plane copper and creating a negative image of the original resonating structure. The layout resonates at a predetermined frequency and acts as an inductive-capacitive loading structure. Thus, by drawing these resonating layouts underneath a broadside antenna, it is possible to drastically reduce the antenna's dimensions by lowering the intrinsic resonant frequency. The invention takes advantage of this property for reducing the size of leaky-wave antennas. Using the inventive technique, the inventors have achieved a 50-60% size reduction. Such miniaturization allows for the design of metamaterial antennas having dimensions small enough for integration on mobile devices.

The design of the miniaturized CRLH unit cell along with the CSRR is described below. Through experimental analysis of the scattering parameters (S-parameters), the inventors will evaluate the impedance characteristics and the expected radiation angles from the dispersion diagram.

Design of the CRLH Unit Cell

Figure 4:
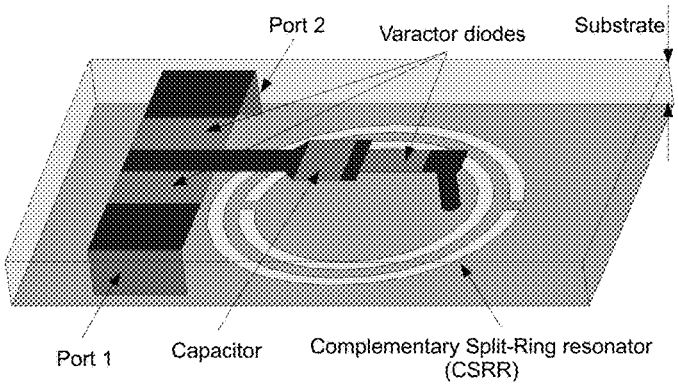
FIG. 4 illustrates a miniaturized single CRLH unit cell implementing a complementary split-ring resonator (CSRR) etched on the bottom layer ground plan in accordance with the invention.

In an exemplary embodiment, the single unit cell is similar to that described above in FIG. 2 or FIG. 3(*b*). In order to achieve miniaturization, a negative image of a Complementary Split-Ring Resonator (CSRR) is etched on the ground plane as shown in FIG. 4. The metallization on the top layer (LWA unit-cell design) is designed to include the lumped components and to resonate within the bandwidth of interest. With respect to a conventional design, the dimension is reduced by about 50-60%. Since the major radiation contribution occurs along the series part, the position of the CSRR was tuned below the shunt stub in order to reduce back lobes amplitude so as to maintain a good front-to-back ratio of the radiation pattern.

Figure 1:
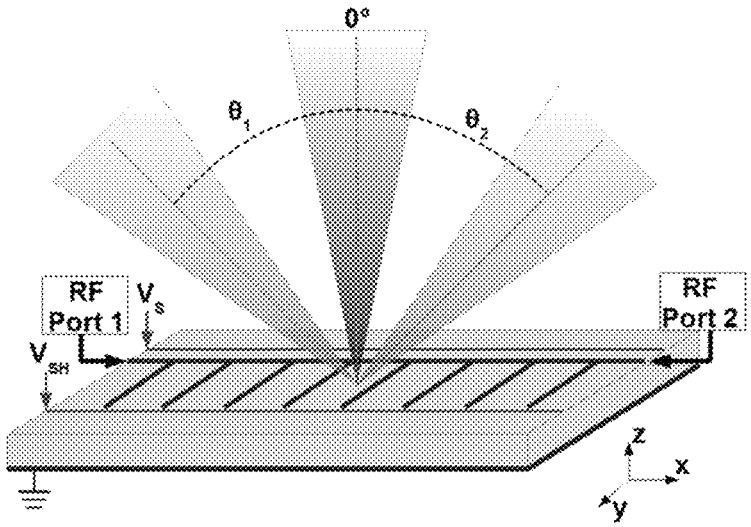
Fig. 1 Prior Art
FIG. 1 illustrates a conventional two-port CRLH-LWA along with a beam steering representation.
Figure 5:
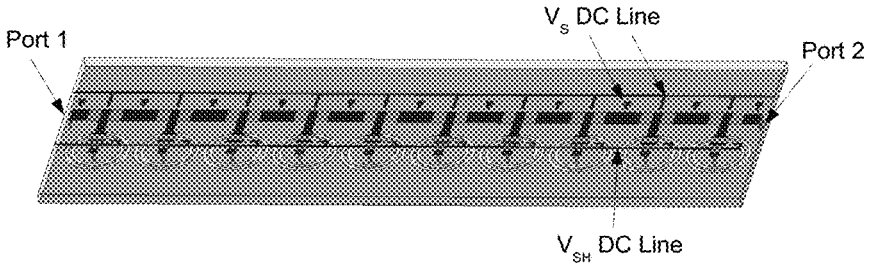
FIG. 5 illustrates a miniaturized CRLH-LWA in accordance with the invention where the DC lines are connected to each unit cell through lumped inductors.
Figure 6A:
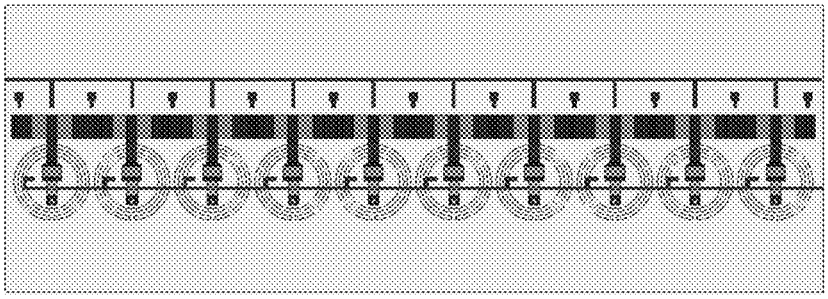
FIG. 6(*a*) illustrates the top layer and FIG. 6(*b*) illustrates the bottom layer of the miniaturized CRLH-LWA of FIG. 5.
Figure 6B:
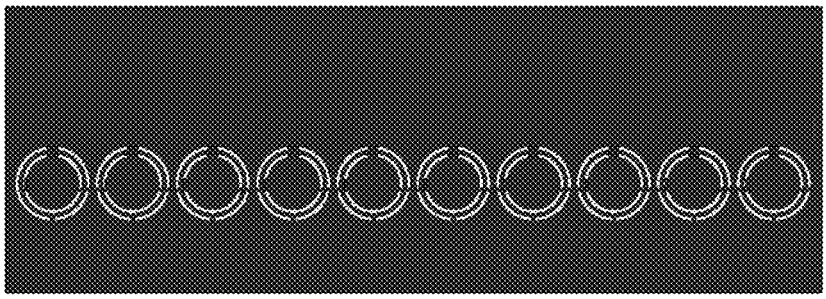

In an exemplary embodiment, the whole miniaturized RLWA is made by cascading several unit cells as described above and shown in FIG. 5. FIG. 5 also shows the details of the DC bias lines and input ports. As shown, the DC lines are connected to each unit cell through RF chokes (lumped inductors). FIG. 6(*a*) shows a top layer view of the cascaded unit cells, while FIG. 6(*b*) shows the bottom layer view with the CSRRs on the ground plane. The cascade of unit cells allows for more leakage of the traveling-wave, thus improving the directivity of the directional beam. Those skilled in the art will appreciate that by increasing the number of cascaded unit cells, higher gain of the whole antenna can be achieved. Input impedance measurements of a prototype showed good impedance matching (return loss below 10 dB) within the entire 2.4 GHz band. Full radiation pattern characterization in an echoic chamber demonstrated the capability of steering a 40° Half-Power-Beamwidth (HPBW) directional beam from −60° to +60° around the plan normal with respect to the antenna surface (azimuth plane, z-x, in FIG. 1).

In an exemplary embodiment of the invention, the defected ground structure can be designed using split rings (as in the CSRR case) or can be done using any other shape (triangular, rectangular, etc.). The shape as well as the number of them for each unit cell can vary based on the design objective in terms of size, frequency, bandwidth, or radiation pattern characteristics.

Figure 7A:
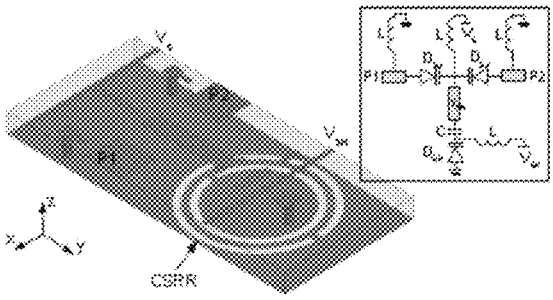
FIG. 7(*a*) illustrates a 3D HFSS model of the CRLH-LWA unit cell of the invention, with CSRR etched on the ground plane.
Figure 7B:
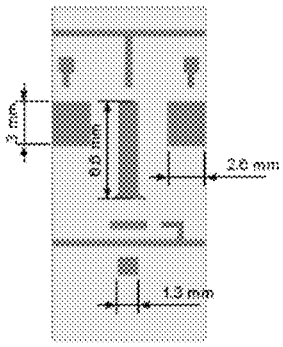
Figure 7C:
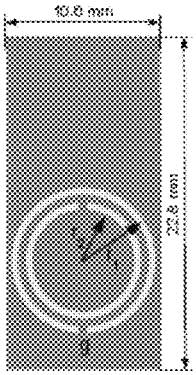

The LWA unit cell of the exemplary embodiment of the invention is shown in FIG. 7(*a*), which was designed on a conventional FR-4 substrate having dielectric constant $\varepsilon_r$=4.4 and thickness t=1.6 mm. The top layout as well as the CSRR were tuned to operate within the entire 2.4 GHz 802.11 Wi-Fi band. The LWA unit cell of FIG. 7(*a*) was designed and tuned using the full-wave electromagnetic simulator Ansoft HFSS. In order to perform more realistic simulations, each lumped component was measured through a 2-port fixture and a Vector Network Analyzer (VNA).

Figure 8:
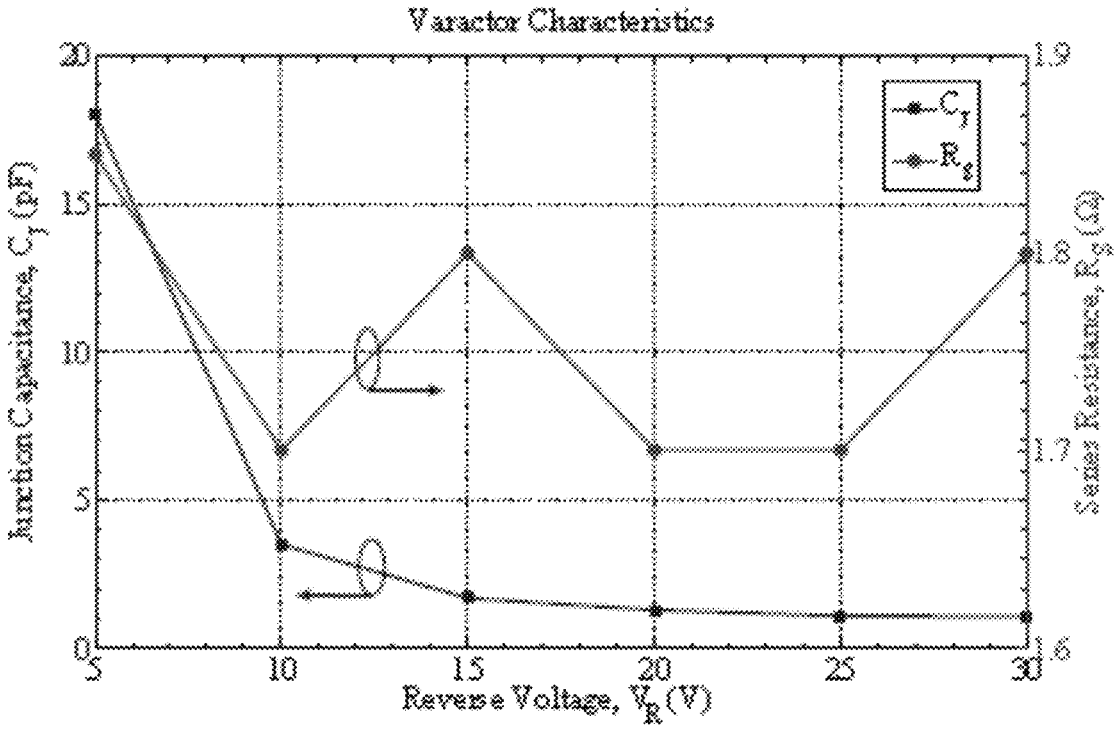
FIG. 8 illustrates the junction capacitance $C_J$ and series resistance $R_S$ as a function of the reverse voltage $V_R$ where the values were extracted from the measured S-parameters. As illustrated, while $R_S$ maintains a relatively constant value within the entire voltage sweep, the capacitance $C_J$ exhibits a larger dynamic range when $V_R \leq 10V$.

Then, the S-parameters (S2P) were loaded into the circuit simulator Ansoft Designer. The co-simulation between HFSS and Designer allows for evaluation of the 3D model using the actual S2P parameters. As a varactor diode, the inventors selected an Infineon BB833, designed to operate up to 2.5 GHz. The inventors chose to use the BB833 because it provided a large dynamic range at low voltages, which reduced the power consumption and the complexity of the control board. In order to get a qualitative evaluation of the capacitance range and loss under reverse bias voltage, the inventors extracted the junction capacitance $C_J$ and the series resistance $R_S$ from the measured S2P. The plot in FIG. 8 shows that the series resistance falls within the range $1.7\Omega \leq R_S \leq 1.85\Omega$ within the entire reverse voltage sweep. However, when $V_R \leq 10V$, the junction capacitance exhibits larger dynamic range: 18 pF$\leq C_J \leq$3 pF. The final unit cell layout has been optimized to take advantage of this large $C_J$ variation under low bias voltages, achieving the largest possible tenability of the phase constant β.

The CRLH behavior is determined by designing the unit cell to have proper series capacitance and a shunt inductive component. The series capacitance is achieved by placing two varactor diodes in series with a common cathode ($D_{S1}$ and $D_{S2}$). The inductive part is designed by means of a shunt stub with a varactor diode ($D_{SH}$) placed in series. The dynamic tuning is accomplished by changing the reverse voltage $V_R$ of the two bias line $V_S$ and $V_{SH}$. A C=0.5 pF capacitor was added to the shunt stub in order to decouple the two bias voltages. To further reduce manufacturing complexity and form-factor, the inventors used L=220 nH inductors that act as RF-chokes to provide the two bias voltages. The inset in FIG. 7(*a*) depicts the resulting schematic of the LWA unit cell. The dimensions are shown in FIG. 7(*b*), and the gaps are properly designed to include the lumped components.

Simulations have shown that by using a standard ground plane, the unit cell operates in the frequency region of 5 GHz. In order to reduce the operating band, a single CSRR was etched underneath the unit cell. The dimensions of the CSRR were varied to reduce the operational frequency to 2.45 GHz and the optimal layout is shown in FIG. 7(*c*). The outer radius is $r_1$=5 mm, while the inner radius is $r_2$=4 mm. The gap g on both rings, as well as the distance between them, is 0.5 mm in an exemplary embodiment. From the simulations, the inventors notice that when the CSRR is positioned at the center of the unit cell, the miniaturization effect is reduced and the resulting radiation patterns exhibit a pronounced back lobe due to radiation leakage from the CSRR apertures on the ground plane. For this reason, the CSRR was slightly moved from the center to the shunt part of the unit cell, in order to reduce the radiation from the ground plane and enhance the front-to-back ratio. As explained below, the effects of the CSRR on the unit cell characteristics is to extend the $S_{11}$ bandwidth, while the dispersion curve $\beta_p$ is intentionally tuned in the RH region through the varactor $C_j$ operating point and the shunt stub dimension.

The CRLH unit cell can exhibit balanced or unbalanced resonances, based on the series and shunt resonant frequencies $\omega_{se}$, $\omega_{sh}$. While the unbalanced unit cell ($\omega_{se} \neq \omega_{sh}$)) supports two different frequencies, the lower for the LH and the higher for the RH regions, the inventors used a balanced unit cell ($\omega_{se}=\omega_{sh}$) in order to avoid the gap between the RH and LH regions, and match the structure over a broad bandwidth. In terms of radiating regions, a CRLH unit cell can typically operate in either the RH or LH regimes. However, in order to achieve the maximum beam coverage by switching between the two input ports, the inventors optimized the design within the RH region (|β|>0). Port 1 is used and the beam can be steered from 0° to max{$\theta_2$}, while by switching to port 2 the beam covers the symmetrical quadrant from 0° to max{$\theta_1$}. This design choice enables full-space beam steering, while taking advantage of the high CJ variation under low voltage regimes. Due to 2-port switching, a similar beamsteering mechanism can be achieved using unbalanced CRLH unit cells.

The experimental analysis conducted on a miniaturized unit cell prototype is described below. The impedance characteristics and the expected radiation angles were evaluated from the dispersion diagram.

Characterization Results

Figure 9A:
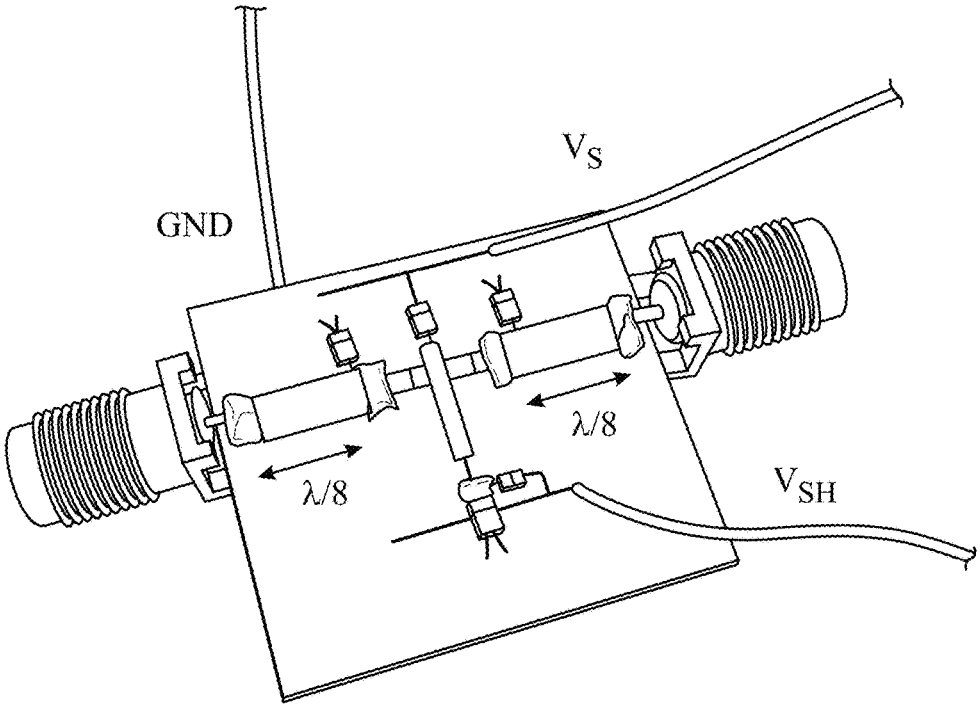
FIG. 9(*a*) and FIG. 9(*b*) illustrate the top and bottom layer pictures of the miniaturized LWA unit cell in a prototype embodiment where the design is etched between two λ/8 microstrip lines for S-parameter measurements.
Figure 9B:
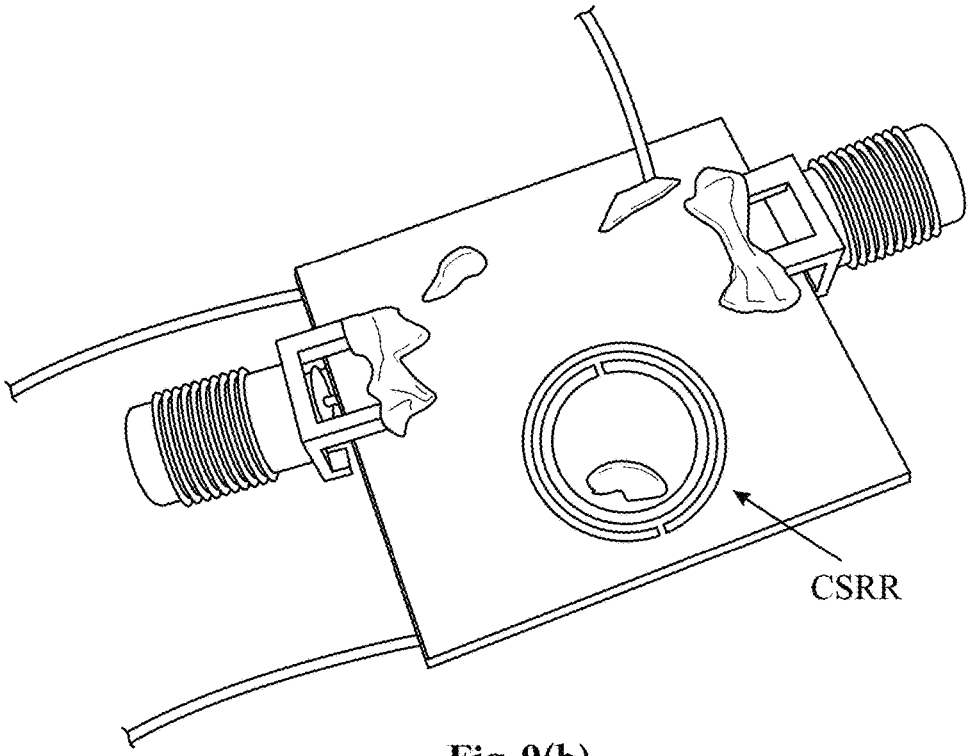

S-parameter measurements were carried out to assess the performance of a miniaturized unit cell prototype and to validate the simulation results. The unit cell was etched between two λ/8 transmission lines for soldering the SMA connectors. An Agilent N5230A Vector Network Analyzer was calibrated with the port extension function for de-embedding the two extra lengths. Top and bottom layers of the manufactured unit cell are shown in FIG. 9.

FIG. 10 shows measured and simulated S-parameters for four arbitrary configurations. Due to port symmetry, in this plot, the inventors assume $S_{11}=S_{22}$ and $S_{12}=S_{21}$ for greater visual clarity. By observing the $S_{11}$ curves, the inventors note that the proposed miniaturized unit cell maintains good impedance matching within the bandwidth of interest from 2.41 to 2.48 GHz. The 10 dB bandwidths are between 220 MHz≤BW≤650 MHz. The measured and simulated S-parameters of the unit cell are in good agreement around the bandwidth of interest: 2.4 GHz-2.6 GHz. Outside the desired bandwidth, the traces start to differ because of the narrow-band S-parameter fixture used for testing. However, the inventors chose to keep a large x-axis range in order to highlight the 10 dB bandwidth.

I the phase constant β is defined as $\beta=d^{-1}\cos^{-1}(1+Z(\omega)Y(\omega))$, where Z(ω) is the series impedance and Y(ω) is the shunt admittance, the two series varactors $D_{s1}$, $D_{s2}$ vary Z(ω) while the shunt varactor $D_{SH}$ varies Y(ω). Furthermore, from inventors' measurements, it was noticed that the series voltage $V_S$ has major control in changing configurations, while the voltage $V_{SH}$ allows for fine-tuning the S-parameters, maintaining the Bloch impedance relatively constant and close to 50Ω. The insertion loss, which includes both actual losses and radiation leakage, is between 0.8 dB≤$S_{21}$≤1.5 dB among the different configurations. The higher deviation between simulation and measurement at the two sides of the bandwidth is potentially due to the S-parameters fixture used to extract the S2P of each lumped component.

In order to evaluate the beam steering capabilities, the dispersion diagram was created using the following equation and the measured S-parameters:

$$B_p = \cos^{-1}\left(\frac{1 - S_{22}S_{22} + S_{21}S_{12}}{2S_{21}}\right) \tag{2}$$

Figure 11:
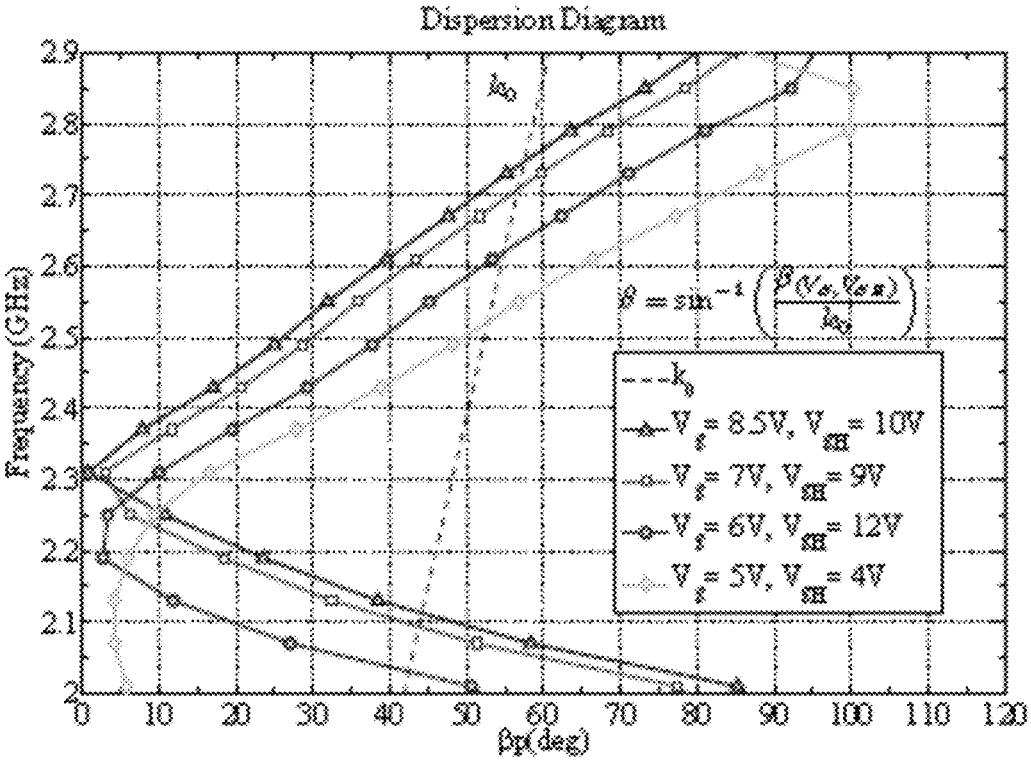
FIG. 11 illustrates a dispersion diagram of the miniaturized CRLH unit cell of the invention where the four different states were taken for incremental values of bias voltages $V_S$ $V_{SH}$. As illustrated, the desired frequency bandwidth, 2.41-2.48 GHz, falls within the RH radiated region.

The dispersion diagram in FIG. 11 shows the result for four different configurations. The inventors note that within the bandwidth of interest, the curves are upward sloping, denoting operation in RH regime. The expected radiation angles θ can be estimated through the equation shown in the inset of FIG. 11 and computed at the desired frequency. By assuming Wi-Fi operation at 2.46 GHz (channel 11), the miniaturized unit cells allow for steering the radiated beam approximately from θ=21° to θ=55° with respect to broadside direction. The beginning of the flip observed in the $V_S$=5V, $V_{SH}$=4V curve is due to the space harmonics periodicity of β, which is given by:

$$\beta=\beta_0+2\eta\pi/d \quad (3)$$

where $\beta_0$ is the lowest order mode phase constant, η is the space harmonics (1, ±1, ±2, . . . ) and d is the period. Although the continuous biasing of varactor diodes allows for a theoretically infinite number of configurations, in Table I the inventors summarize four significant configurations to achieve uniform beam steering based on the HPBW of each beam. The relative Bloch impedance $Z_b$ and expected beam angle θ are also reported.

TABLE I

Summary of four different configurations at the frequency of 2.46 GHz

| Configuration $\{V_S, V_{SH}\}$ | Block Impedance $Z_b$ | Beam Angle θ |
|---|---|---|
| {8.5 V, 10 V} | 42 + j8 Ω | 21° |
| {7 V, 9 V} | 37 + j7 Ω | 28° |
| {6 V, 12 V} | 47 + j10 Ω | 38° |
| {5 V, 4 V} | 56 + j9 Ω | 55° |

The aforementioned results enable the cascading of the miniaturized unit cell to create a complete leaky-wave antenna for the 2.4 GHz Wi-Fi band. The design of a reconfigurable CRLH LWA made by cascading 11 miniaturized unit cells, with experimental analysis of impedance and radiation characteristics will now be described.

Miniaturized CRLH Leaky-Wave Antenna

Figure 12A:
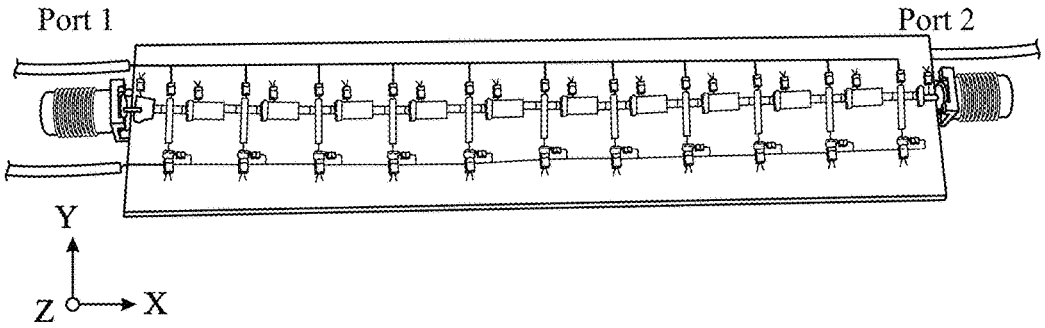
FIG. 12(*a*) and FIG. 12(*b*) illustrate the miniaturized CRLH-LWA of the invention where FIG. 12(*a*) shows the top layer with cascade or N=11 unit cells and FIG. 12(*b*) shows the bottom layer with CSRRs for overall dimensions l=11.5 cm and h=2.3 cm.
Figure 12B:
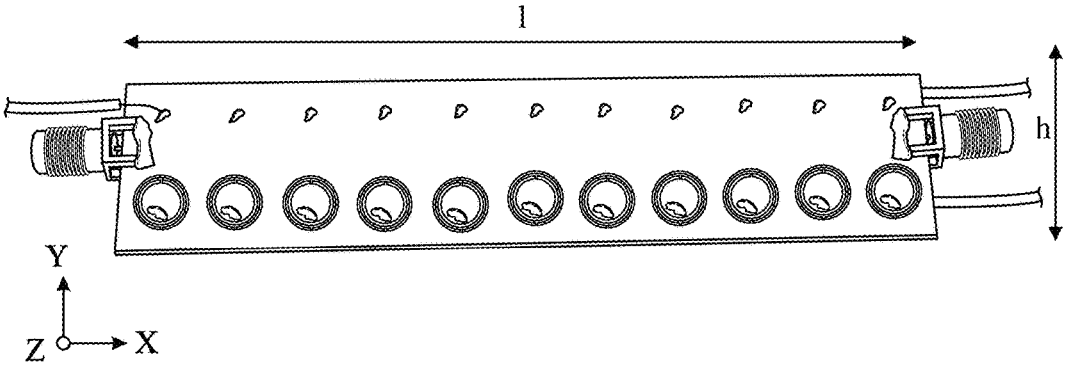

The periodic structure of the miniaturized CRLH LWA was designed by cascading a series of unit cells described above. As illustrated in FIG. 12, the antenna comprises N=11 unit cells and has overall dimension l=11.5 cm and h=2.3 cm. The number of unit cells was selected to achieve positive gain and obtain a fair comparison with the earlier LWA presented by Patron et al. By switching between the two input ports, the antenna allows for the generation of two independent beams that can be steered from back-fire to end-fire, with expected beam angles θ estimated during the unit cell analysis.

Input Impedance

The return loss and the isolation of the two input ports have been measured through a VNA. The $S_{11}$ and $S_{22}$ scattering parameters describe the impedance integrity between the antenna's ports and a 50Ω feed line, whereas the $S_{12}$ and $S_{21}$ render the isolation achievable between them. FIG. 13 shows the measured scattering parameters for the four configurations listed in Table I.

Both input ports exhibit good impedance matching within the 2.41-2.48 GHz band, the small discrepancies between the $S_{11}$ and $S_{22}$ curves are potentially due to the manufacturing process and, in particular, the manual population of the board. The inventors also note that the 10 dB bandwidth is relatively large, between 1 GHz≤BW≤1.3 GHz. In terms of decoupling between the two port, at 2.46 GHz the antenna's isolation is within the range of 8 dB≤$S_{21}$≤10 dB.

Radiation Patterns

Figure 15:
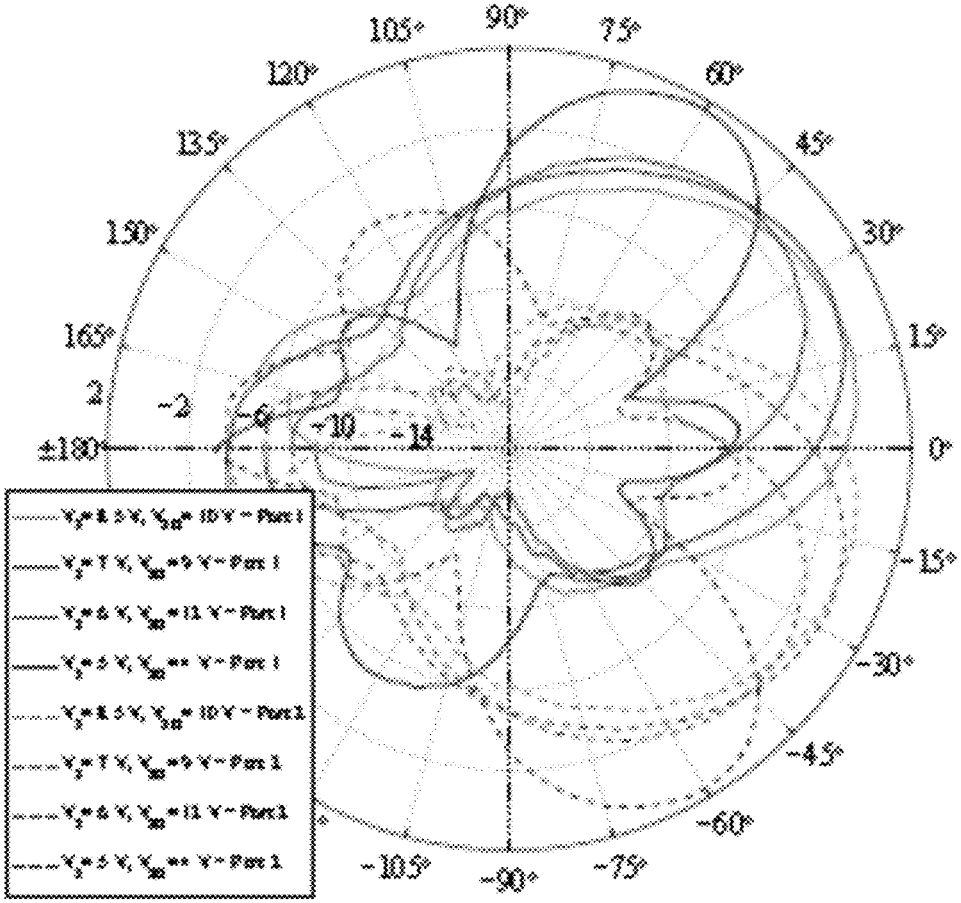
FIG. 15 illustrates the azimuth (x-z) view of the total beam steering capabilities where the solid lines depict beams generated by exciting port 1 (and port 2 terminated to a 50Ω load), whereas the dashed beams with port 2 (and port 1 terminated to a 50Ω load).

In order to evaluate the radiation characteristics of the proposed antenna and the agreement with the expected angles, the inventors have measured the radiation patterns for the four configuration listed in Table I. For this purpose, the inventors used the tool EMSCAN RFxpert, which is a bench-top measurement system that enables one to get 3D and 2D antenna pattern measurements in real time. FIG. 14 shows the 3D antenna directivity graphs measured at 2.46 GHz by exciting port 2 and terminating port 1 to a 50Ω load. The steering angles are in good agreement with the expected values. The minimum gain is 0 dBi while the peak is about 2 dBi, with front-to-back ratio between 5 and 8 dB, depending on the adopted configuration. The major losses that limit the gain are the series resistance of the varactor diode $R_S$ and the lossy FR-4 substrate. More expensive substrates can provide much lower loss factors, while the series resistance of varactor diodes could be improved by choosing a smaller package or more expensive models. Further measurements were conducted in an anechoic chamber and FIG. 15 illustrates the azimuth cut (x-z) with the complete set of radiation patterns accomplished by switching between the two input ports. The total steering angle is about 120° and the half-power beamwidth (HPWB) of each beam, between 40° and 60°, allows for nearly uniform coverage. The measurements in FIG. 15 denote good agreement with the expected beam angles listed in Table I. By comparing the same voltage considerations, the error between the estimated and the measured beam angles is between 0° and 5° across all the configurations.

In terms of beam polarization, the inventors observed that the miniaturized CRLH LWA maintains linear polarization across all the configurations, similarly to a conventional LWA. In FIG. 16, the inventors show the normalized plots of co-pol and cross-pol for four beams at ±60° and ±30°. For all the configurations, the cross-pol is at least 5 dB lower than the co-pol confirming that the radiated fields are linearly polarized.

Comparison with Conventional LWA Model

Figure 2:
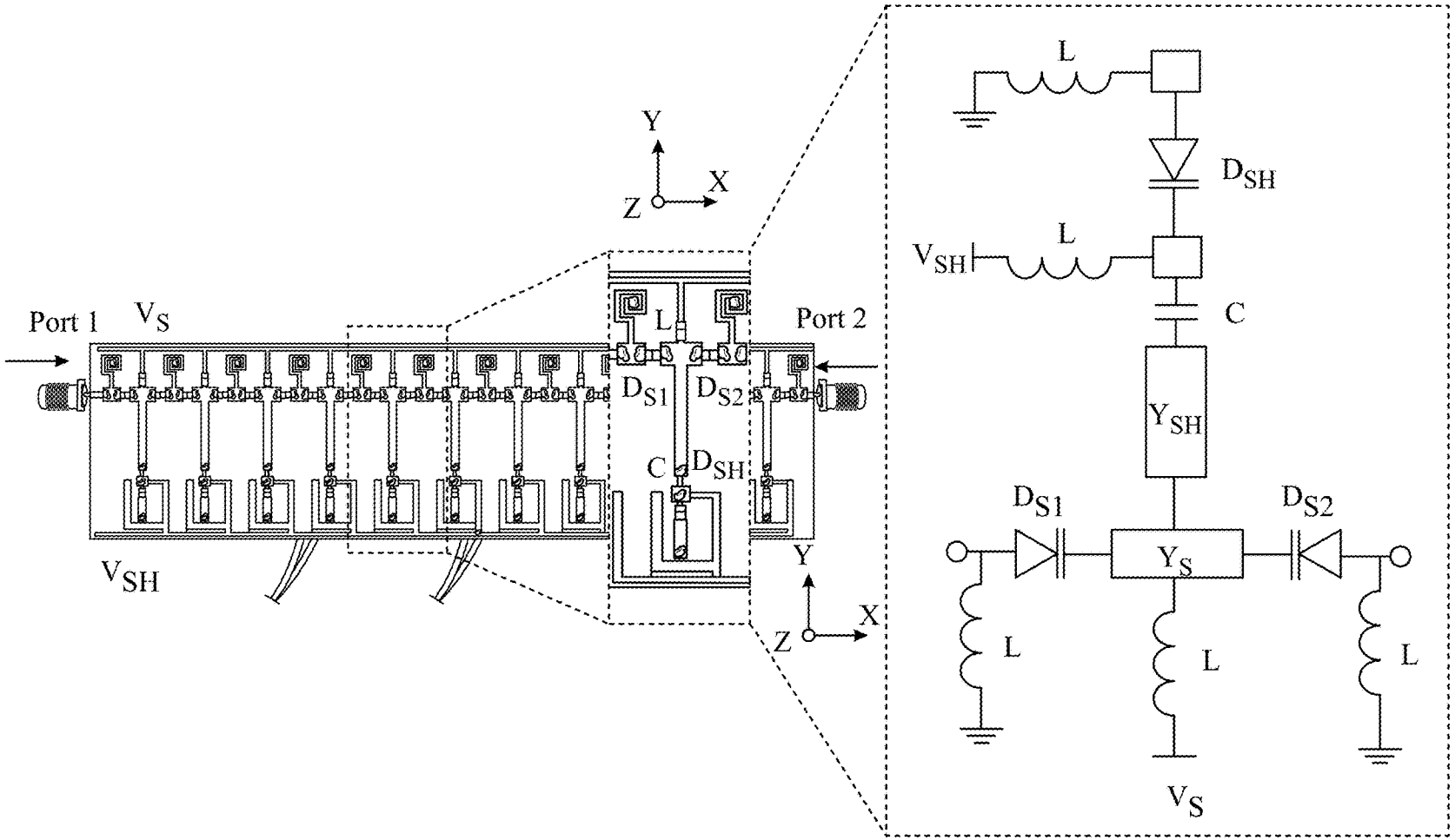
Fig. 2 Prior Art
FIG. 2 illustrates a conventional CRLH-LWA showing the detail of the unit cell.
Figure 17:
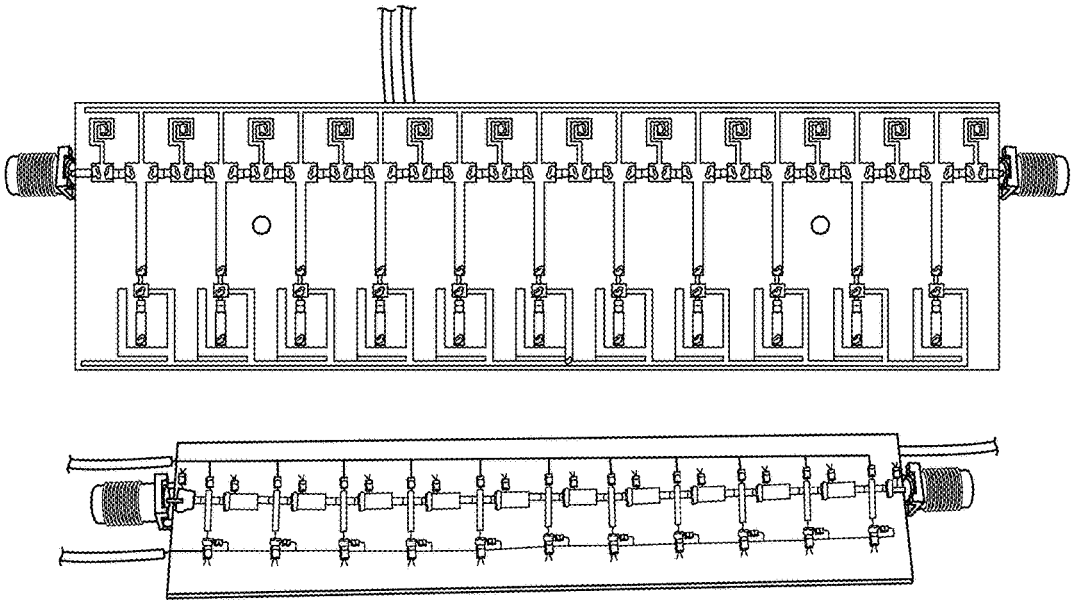
FIG. 17 illustrates a comparison between the conventional and the miniaturized reconfigurable LWA of the invention. Both antennas were designed by cascading N=11 unit cells. The former occupies an area of 56 $cm^2$ while the latter 26.5 $cm^2$.

In FIG. 17, the inventors compare the size of the proposed miniaturized LWA with the earlier conventional design of a LWA as described with respect to prior art FIG. 2. Both antennas were designed by cascading 11 unit cells; however, the miniaturized LWA is about 53% smaller than the conventional LWA. The inventors then conducted a qualitative comparison of the electrical and radiation characteristics to evaluate the performance of the proposed miniaturized LWA. A summary is shown in Table II.

TABLE II

Comparison between conventional and miniaturized LWAs

| | Conventional LWA | Miniaturized LWA |
|---|---|---|
| Dimension | 56 $cm^2$ | 26.5 $cm^2$ |
| 10 dB Bandwidth (Max) | 30 MHz | 1.3 GHz |
| Isolation (min) | 10 dB | 8 dB |
| Peak Gain | 4 dBi | 2 dBi |
| Front-to-Back Ratio (avg) | 8 dB | 7 dB |
| Beamsteering Coverage | 120° | 120° |

The 10 dB bandwidth of the miniaturized LWA is significantly larger than the conventional model. However, it is important to recall that due to the frequency-dependency, different frequency regions will exhibit different handedness regions (i.e., RH or LH) and thus different steering angles. Moreover, when the dispersion curve approaches the propagation regime, the beam's directivity and gain degrade. Also, due to the smaller dimension, the isolation between the two input ports is lower with respect to the standard model. Although more than the 85% of the energy is being radiated and attenuated through the structure, the employment of a single-pole-double-throw (SPDT) switch would allow to further decouple the two ports, and switch between them to generate the desired back-fire and end-fire beams. Furthermore, the cascade of additional unit cells can also lead to higher isolation between the ports, and increases the radiated gain.

In terms of radiation characteristics, the miniaturized LWA allows for beam steering of about 120° around the azimuth plane, similar to the earlier version. The peak gain is 2 dB lower, but sufficient to utilize the antenna for mobile applications. The front-to-back ratios are comparable, with both antennas performing between 4 and 8 dB, depending on the adopted configuration.

Advantages of Miniaturized CRLH-LWA

As noted above, the main advantage of the invention is that it allows designing miniaturized Reconfigurable Leaky-Wave Antennas for their application on mobile (laptop or handheld) devices. Conventional miniaturization techniques involve the use of customized substrates or the stacking of reactive substrate layers. However, such miniaturized antennas are costly and bulky. In accordance with the techniques of the invention, by simply etching the antenna's ground plane, the inventors have drastically miniaturized the dimensions of the Reconfigurable Leaky-Wave Antennas, resulting in a very cost effective and easy to manufacture device. The techniques described herein as applied to Reconfigurable Leaky-Wave Antennas allows for size reduction of at least 50%, which opens new venues to apply such antennas to mobile devices.

In prior art broadside antennas loaded with CSRR for miniaturization, the defected ground structure created by the CSRR causes a leakage of the radiation pattern through the ground plane so as to generate a higher amplitude of the back lobe. The designs of the invention on Leaky-Wave Antennas avoid such problems and maintain a relatively high front-to-back ratio of the main beam. This is accomplished by moving the CSRR below the shunt stub and preventing etching below the series part of the unit cell. Since the major radiation contribution occurs along the series part, the strategic position of the CSRR is tuned in such a way as to reduce the amplitude of back lobes so as to maintain good front-to-back ratio of the radiation patterns.

Using Leaky-Wave Antennas allows for continuous scanning of wireless channels through a theoretically infinite number of radiation patterns. The aim of scanning continuously different directions with directional beams is two-fold. When an isolated receiver is located at a certain position, the antenna is capable of focusing the energy in that direction without wasting power in the surrounding space. On the other hand, then multiple users are located within a certain angle (i.e., sector), a sectorial coverage is possible by continuously scanning that sector. The latter approach outperforms a static sector antenna, which has a coverage area that is typically reduced at the edges of that sector. A continuous scan with a high gain reconfigurable beam has been shown to allow a more uniform coverage and thanks to higher directional gain it also allows for coverage of a wider area. The miniaturization of the RLWA enables exploitation of this important feature even on a mobile device, whereas currently it can only be applied on wireless base stations.

As noted herein, the radiation pattern as well as resonant frequency of the Reconfigurable Leaky-Wave Antenna can be electronically changed by setting the two sets of voltages across varactor diodes. As a result, the antenna can be tuned to steer directional beams over a large frequency bandwidth, covering for example the whole 2.4 GHz band or the 5 GHz Wi-Fi bands. In addition, the defected ground structure of the CSRR can also be used to make the antenna dual-band.

The miniaturization method described herein is very cost effective as it just requires etching of the ground plane. The method can be applied to any commercial substrate without additional manufacturing complexity. In addition, the whole LWA manufacturing process is comparable to the production of a simple dual layer PCB circuit, which can be accomplished using standard commercial processes. Size reduction above 50% also leads to a savings in a large quantity of substrate with respect to current designs.

Conventional Wi-Fi routers and access points are characterized by a small form factor and flat designs. The planar layout of the RLWA of the invention is particularly suitable for such applications and its miniaturization allows it to maintain small and flat dimensions for Wi-Fi and Femtocell base station devices. On the other hand, due to the significant size reduction, the miniaturized RLWA of the invention can be implemented as a smart antenna in mobile devices such as laptops and tablets. The low profile (1 cm×10 cm at 2.4 GHz) makes it ideal for installation on the plastic frame of LCD screens, which is the typical location of antennas on laptops.

CONCLUSION

A miniaturized reconfigurable leaky-wave antenna is provided where the size reduction was accomplished by etching a complementary split-ring resonator (CSRR) underneath each unit cell. The CSRR was designed to decrease the size of an improved design of CRLH unit cell, covering the whole Wi-Fi band from 2.41 GHz to 2.48 GHz. The absence of interdigital capacitors greatly reduces manufacturing constraints for size reduction while also allowing the application of the CSRR miniaturization technique. Numerical and experimental analysis of the miniaturized unit cell have shown good impedance performance and relatively large variations of the dispersion curves, which leads to large beam steering.

After fine tuning the unit cell for the desired radiating region and steering angles, the miniaturized leaky-wave antenna has been designed by cascading 11 unit cells. With respect to an equivalent conventional LWA model, the miniaturized antenna is 53% smaller and exhibits a larger 10 dB bandwidth. The radiation patterns were in good agreement with the expected angles, and the total azimuth coverage is about 120° with gains between 0 and 2 dBi.

The technique of etching CSRR on reconfigurable leaky-wave antennas has been shown to be successful for size reduction and maintenance of good radiating performance. The invention enables the development of miniaturized reconfigurable antennas that do not require expensive and customized substrates. The antenna as described herein may be applied on software-defined radios to realize new wireless networking applications exploiting directionality on mobile device platforms.

Those skilled in the art also will readily appreciate that many additional modifications and scenarios are possible in the exemplary embodiment without materially departing from the novel teachings and advantages of the invention. Accordingly, any such modifications are intended to be included within the scope of this invention as defined by the following exemplary claims.

What is claimed:

1. A device comprising:

a reconfigurable leaky-wave antenna comprising a plurality of cascaded metamaterial unit cells where each unit cell has a complementary resonator in its ground plane, and adjustable varactor diodes that are biased to change a propagation constant through the plurality of cascaded metamaterial unit cells so that a directive beam from the reconfigurable leaky-wave antenna can be steered around an azimuth plane, wherein each of the plurality of cascaded metamaterial unit cells comprises a shunt component, wherein the shunt component comprises a first varactor diode in series with a shunt stub.

2. The device as in claim 1, wherein the plurality of cascaded metamaterial unit cells comprise composite right/left-handed (CRLH) unit cells placed on top of complementary resonators in a ground plane.

3. The device as in claim 1, wherein the complementary resonator is a split-ring resonator.

4. The device as in claim 2, wherein the complementary resonator has a shape and a number for each unit cell that is varied based on a size, frequency, bandwidth, or radiation pattern characteristics of the CRLH unit cell.

5. The device as in claim 4, wherein the complementary resonator is triangular or rectangular in shape.

6. The device as in claim 1, wherein the directive beam radiates into free space from the antenna.

7. The device as in claim 1, wherein each of the plurality of cascaded metamaterial unit cells comprises a series component coupled to the corresponding shunt component, and wherein the series component comprises a second varactor diode in series with a third varactor diode.

8. The device as in claim 7, wherein one or more of varying a first bias voltage to the first varactor diode or a second bias voltage to the second varactor diode and the third varactor diode causes the directive beam radiated from the antenna to be steered around the azimuth plane.

9. The device as in claim 7, wherein the shunt component is electrically coupled to the series component between the second varactor diode and the third varactor diode, and wherein the shunt component comprises a capacitor coupled between first varactor diode and the series component.

10. The device as in claim 1, wherein the complementary resonator in one or more of the plurality of cascaded metamaterial unit cells is disposed towards the corresponding shunt component.

11. A device comprising: a reconfigurable leaky-wave antenna comprising a plurality of cascaded metamaterial unit cells where each unit cell has a complementary resonator in its ground plane, and adjustable varactor diodes that are biased to change a propagation constant through the plurality of cascaded metamaterial unit cells so that a directive beam from the antenna can be steered around an azimuth plane, wherein each of the plurality of cascaded metamaterial unit cells comprise one or more inductors configured as RF-chokes that supply one or more of bias voltages.

12. A method comprising:

forming a reconfigurable leaky-wave antenna comprising:

etching a complementary resonator in a ground plane for each of a plurality of cascaded metamaterial unit cells, providing a CRLH leaky-wave transmission line on top of the complementary resonator for each metamaterial unit cell, and placing the plurality of cascaded metamaterial unit cells between respective ports, wherein each of the plurality of cascaded metamaterial unit cells comprises a shunt component coupled to a series component, and wherein the shunt component comprises a first varactor diode in series with a shunt stub, and wherein the series component comprises a second varactor diode in series with a third varactor diode.

13. The method as in claim 12, further comprising providing adjustable varactor diodes for each of the plurality of cascaded metamaterial unit cells and biasing said adjustable varactor diodes to change a propagation constant through the plurality of cascaded metamaterial unit cells so that a directive beam from the antenna can be steered around an azimuth plane.

14. The method as in claim 12, wherein the complementary resonator is a split-ring resonator.

15. The method as in claim 12, wherein the complementary resonator has a shape and a number for each unit cell that is varied based on a size, frequency, bandwidth, or radiation pattern characteristics of the complementary resonator of the unit cell.

16. The method as in claim 15, wherein the complementary resonator is triangular or rectangular in shape.

17. The method as in claim 12, wherein the antenna is configured to radiate a beam into free space.

18. The method as in claim 12, wherein the complementary resonator in one or more of the plurality of cascaded metamaterial unit cells is disposed towards the shunt component.

* * * * *